United States Patent [19]

Baldwin

[11] Patent Number: 4,478,411

[45] Date of Patent: Oct. 23, 1984

[54] APPARATUS AND METHOD FOR EXERCISING THE ABDUCTOR OR ADDUCTOR MUSCLES

[75] Inventor: Dan D. Baldwin, Independence, Va.

[73] Assignee: Nautilus Sports/Medical Industries, Inc., Lake Helen, Fla.

[21] Appl. No.: 238,454

[22] Filed: Feb. 26, 1981

[51] Int. Cl.[3] ..... A63B 21/06

[52] U.S. Cl. ..... 272/118; 272/134

[58] Field of Search ..... 272/118, 117, 134, 130, 272/135

[56] References Cited

U.S. PATENT DOCUMENTS

| | | | |
|---|---|---|---|
| 3,858,873 | 1/1975 | Jones | 272/134 X |
| 3,912,261 | 10/1975 | Lambert | 272/118 |
| 4,125,258 | 11/1978 | McArthur | 272/118 |
| 4,149,713 | 4/1979 | McLeod | 272/134 X |
| 4,207,859 | 6/1980 | Scholten | 124/24 R |
| 4,240,627 | 12/1980 | Brentham | 272/134 |

FOREIGN PATENT DOCUMENTS

| | | | |
|---|---|---|---|
| 122994 | 8/1901 | Fed. Rep. of Germany | 117/ |

*Primary Examiner*—Richard J. Apley
*Assistant Examiner*—William R. Browne
*Attorney, Agent, or Firm*—Bell, Seltzer, Park & Gibson

[57] ABSTRACT

Apparatus and method for exercising the abductor or adductor muscles in which the legs of the user are moved away from and toward one another and in which resistance to leg movement varies in predetermined relationship to leg movement. The apparatus is connected through link structure to accommodate rotation of the legs relative to the torso supporting structure. The rotations of the legs, both away from and toward each other, of a user is resisted by weights that are raised and lowered.

5 Claims, 11 Drawing Figures

APPARATUS AND METHOD FOR EXERCISING THE ABDUCTOR OR ADDUCTOR MUSCLES

FIELD AND BACKGROUND OF INVENTION

Exercising undertaken by persons training for athletic events of various types or pursuing a course of treatment for the rehabilitation of an illness, injury or the like has, in recent years, come to involve the use of various apparatus or machines. Such apparatus, machines and methods have grown out of various concepts and studies regarding physiology and physiological development and function.

One type of apparatus and method which has been used with significant success is full range exercise such as is possible, for example, through use of the apparatus of Jones, U.S. Pat. No. 3,858,873. "Full range" exercise as used with reference to such an apparatus and method, and as used in the description which follows, is a defined term. The defined term "full range exercise" refers to exercise having positive work; negative work; rotary form movement; stretching; prestretching; automatically variable, balanced, direct resistance; resistance in the position of full muscular contraction; and substantially unrestricted speed of movement. The interested reader is referred to available publications for further explication of these characteristic features of full range exercise.

The general field of such exercise in related apparatus and methods is here referred to as "exercise physiology". The field of exercise physiology is related to sports medicine, being the field of medical study which is particularly directed to athletic sports and the like. The development of the field of exercise physiology has involved, among other things, the continuing development of apparatus and methods to accomplish precise application of exercising programs to specific muscles or muscle groups. One such muscle group is the muscle group responsible for movement of legs away from and toward one another. The muscle groups are referred to as abductor and adductor muscles.

BRIEF DESCRIPTION OF INVENTION

It is an object of the present invention to accomplish exercising of abductor or adductor muscles of the leg. In realizing this object of the present invention, exercising apparatus is provided and has means for engaging and supporting portions of the body of a user. In particular, a torso supporting means is provided for supporting a user's upper body and leg support means are provided for supporting a user's leg. The leg support and torso support are connected together in a particular manner so as to accommodate rotation of the leg supporting means relative to the torso supporting means and about an axis extending through the corresponding hip joint of the user. In accordance with the present invention, resistance means is provided for imposing on the leg support force resisting movement of the leg support in at least one of directions of away from and toward the user's other leg.

Yet a further object of the present invention is to accomplish exercising of abductor or adductor muscles of the leg of a user of an exercising apparatus in accordance with a method by which a varying resistance force is applied to a user's leg during movement thereof in at least one of directions of away from and toward the other leg. In realizing this object of the present invention, the amount of force imposed in resisting movement of a leg changes in predetermined relationship to movement of the leg away from and toward a user's other leg.

Yet a further object of the present invention is to exercise abductor or adductor muscles of the leg of a user of an exercising apparatus while restricting movement of the legs to equiangular bilateral rotation away from and toward one another. In realizing this object of the present invention, balanced exercise of right and left legs is facilitated.

BRIEF DESCRIPTION OF DRAWINGS

Some of the objects of the invention having been stated, other objects will appear as the description proceeds, when taken in connection with the accompanying drawings, in which—

DETAILED DESCRIPTION OF INVENTION

While the present invention will be described hereinafter with particular reference to the accompanying drawings, in which an operating embodiment of the apparatus of the present invention is shown, it is to be understood at the outset of the description which follows that it is contemplated that apparatus and methods in accordance with the present invention may be varied from the specific form described hereinafter while still attaining the desired result of this invention. Accordingly, the description which follows is to be understood as a broad teaching disclosure directed to persons of appropriate skill in the appropriate art, and not as limiting upon the scope of this invention.

Figure 3:
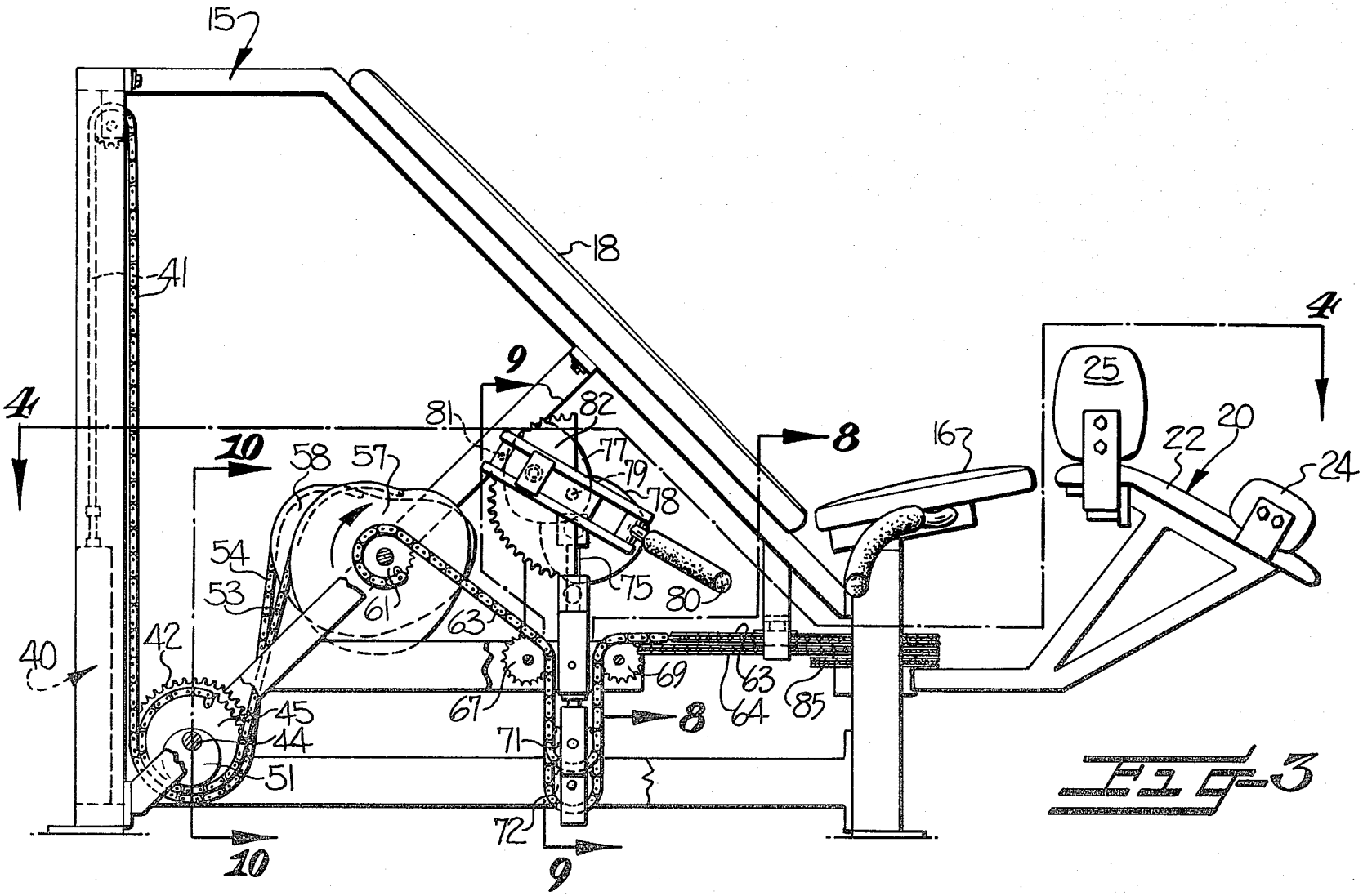
FIG. 3 is a elevation view of the apparatus of FIG. 1, with covers removed therefrom to expose certain components of the apparatus.
Figures 4, 5, 6, 7:
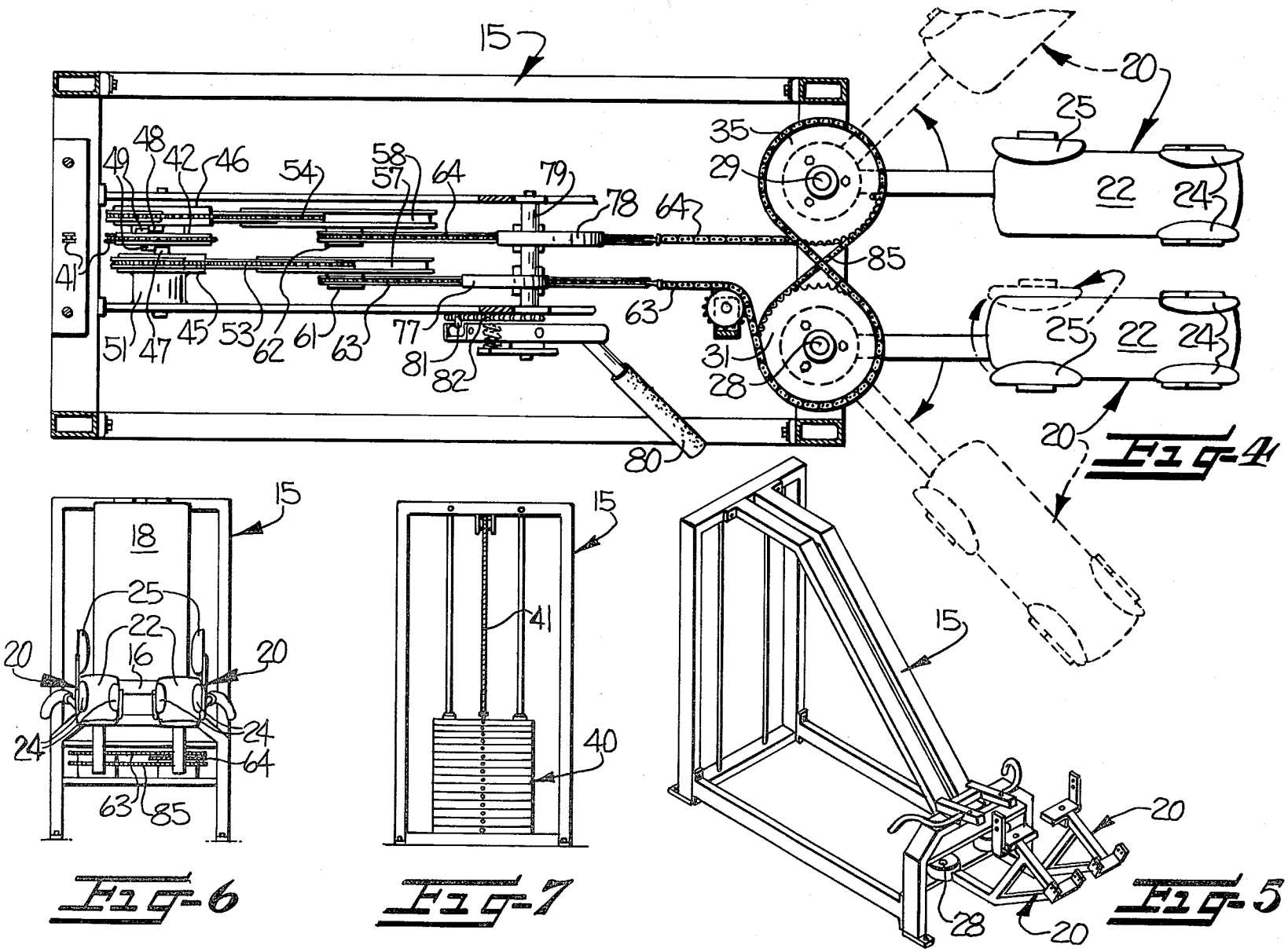
FIG. 4 is a plan view, partially in section, taken generally along the line 4—4 in FIG. 3.
FIG. 5 is a perspective view of the framework of the apparatus of FIGS. 1 through 4.
FIG. 6 is a front elevation view of the apparatus of FIGS. 1 through 4.
FIG. 7 is a rear elevation view of the apparatus of FIGS. 1 through 4.
Figure 8:
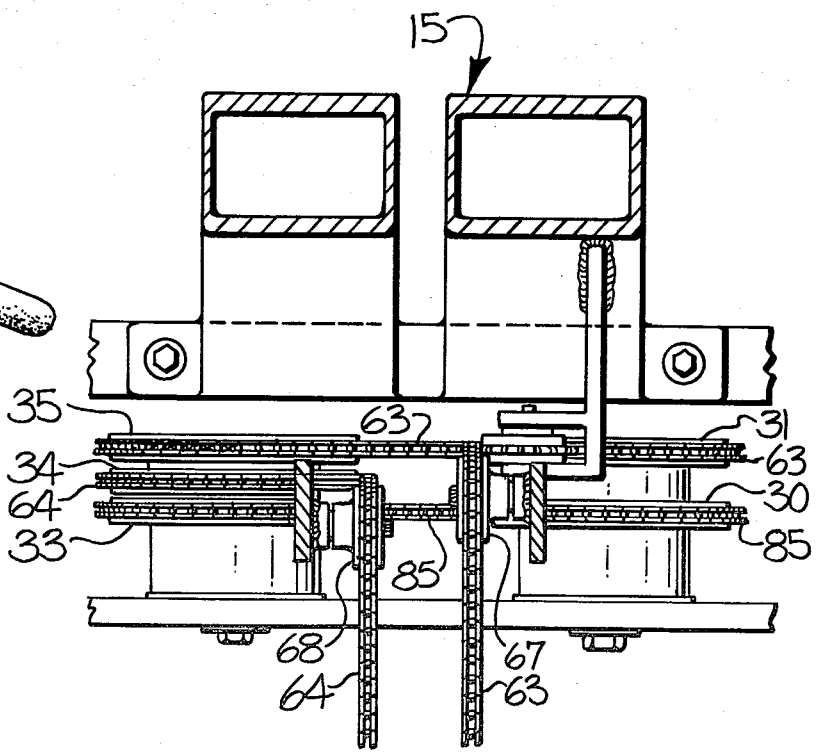
FIG. 8 is an elevation view, partially in section, taken generally along the line 8—8 in FIG. 3.
Figure 9:
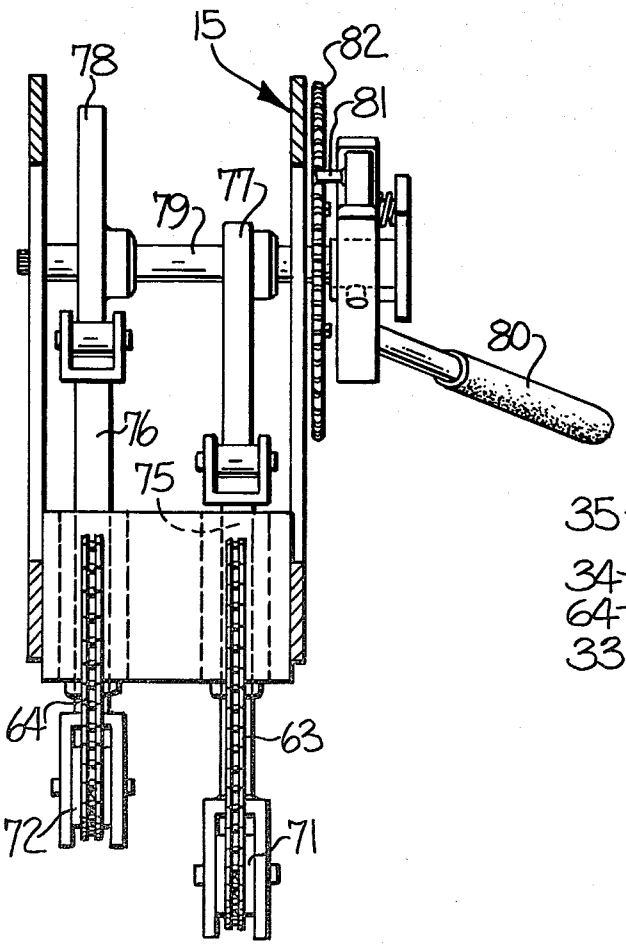
FIG. 9 is a view similar to FIG. 8, taken generally along the line 9—9 in FIG. 3.
Figure 10:
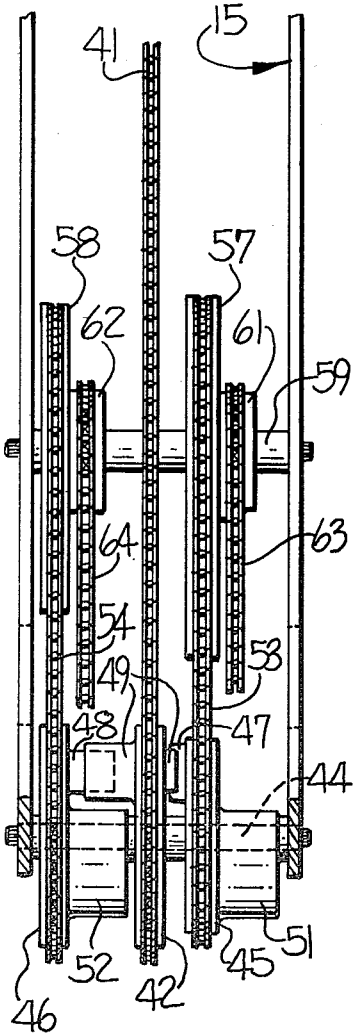
FIG. 10 is a view similar to FIGS. 8 and 9, taken generally along the line 10—10 in FIG. 3.

Referring now more particularly to FIGS. 1 through 4, an apparatus for exercising abductor or adductor muscles of the leg in accordance with the present invention is there shown. The apparatus includes a frame structure preferably fabricated from steel tubing and generally indicated at 15. Mounted on the frame is a torso supporting means for supporting a user's upper body. In the illustrated form of the invention, the torso supporting means takes the form of a seat 16 and a backrest 18. Preferably, and as shown in FIG. 3, the seat 16 and backrest 18 are inclined so as to support a user's upper body in a partly reclining position.

The apparatus includes leg support means, generally indicated at 20, for supporting a user's leg. Preferably, and as illustrated, the leg support means takes the form of right and left leg supports 21, 22 for respectively engaging the right and left legs of a user of the apparatus of this invention. As pointed out more fully hereinafter, the leg support means 20 have retainers 24 at the lower portions of the leg supports 21, 22 and thigh retainers 25 adjacent the seat 16. The thigh retainers 25 are rotatable about generally vertical axes for movement between a position engaging the outside of the respective leg and a position engaging the inside of the respective leg. Means are provided (FIGS. 3, 4 and 11) for mounting the leg supporting means 20 for rotation relative to the torso supporting means and about axes extending through corresponding hip joints of the user. In the form illustrated, the means mounting the leg supporting means comprises a pair of spaced shafts 28, 29 mounted in the frame 15 for rotation about spaced, generally vertical axes. One shaft 28 has a pair of sprockets 30, 31 fixed thereto for rotation therewith. The other shaft 29 has three sprockets 33, 34, 35 fixed therewith for rotation. From one of the sprockets 30, 33 for each of the shafts 28, 29 extend frames on which pads forming the leg support means 20 are mounted.

Resistance means (FIGS. 3, 4 and 8 through 11) is operatively connected to the mounting means for imposing on the leg supports force resisting movement of one of the leg supports in at least one of two directions, namely away from and toward the other leg of a user. As pointed out more fully hereinafter, the resistance means has variation means for changing the amount of force imposed in predetermined relationship to movement of the leg support means away from and toward one another, in the instance of a symmetrical bilateral exercise.

In the form illustrated, the resistance means comprises a weight stack generally indicated at 40 (FIGS. 1, 3, 4, 7 and 11). By means of known interconnection of selected weights in the weight stack 40 with a chain 41, lifting of the weight stack 40 or a portion thereof will impose, through the chain 41, a rotational torque on a center sprocket 42 mounted for rotation about a back shaft 44. Also mounted for rotation about the back shaft 44 are a pair of freely rotatable sprockets 45, 46 each having a catch (respectively identified at 47, 48) extending toward the sprocket 42 which is mounted therebetween. The catches 47, 48 cooperate with a dog bar 49 which extends from the center sprocket 42 for transferring force as described more fully hereinafter. In order to counterbalance each of the freely rotatable sprockets 45, 46, each is provided with a counterweight as indicated at 51, 52, respectively.

Force is transmitted from each of the freely rotatable sprockets 45, 46, when appropriate and as pointed out more fully hereinafter, through a corresponding one of a pair of chains 53, 54. Each chain passes to and is entrained about a corresponding cam 57, 58 which forms a portion of a variation means for changing the amount of force imposed in predetermined relationship to movement of the leg supports, as briefly referred to hereinabove. The cams 57, 58 are mounted for rotation about a cam shaft 59. Each cam 57, 58 includes a sprocket 61, 62 about which are entrained chains 63, 64 which extend forwardly of the frame 15 of the exercise apparatus to engage corresponding ones of the sprockets 31, 35, 34 forming portions of the mounting means described hereinabove.

Intermediate the cams 57, 58 and the sprockets 31, 35, 34 forming portions of the mounting means described above is provided a selection means operable by a user of the exercising apparatus and operatively connected to the first and second variation means provided by the cams 57, 58 for selecting one of the means as imposing force. More particularly, the respective chains 63, 64 are trained over corresponding pairs of guide sprockets 67, 68, 69, 70 so as to provide slackening loops therebetween. That is, between each pair of guide sprockets engaging a common chain, such as the sprockets 67, 69 engaging a common chain 63, the chain 63 dips downwardly and passes about a control sprocket. In the instance of the chain 63, the control sprocket is identified at 71. In the instance of the chain 64, the control sprocket is identified at 72.

Each of the control sprockets is mounted at the lower end of a corresponding actuating rod 75, 76. The upper ends of the actuating rods 75, 76 are engaged by corresponding control cams 77, 78. The cams 77, 78 are fixed to a common mounting shaft 79 and are rotatable with that shaft under the control of a manually operable handle 80. As made more clear by reference to FIG. 2, the handle 80 may be manipulated by a user seated in the apparatus of the present invention to withdraw a locking pin 81 from a locking sector 82. With the pin 81 withdrawn from the sector 82, the handle 80 may be moved to rotate the shaft 79 and the control cams 77, 78. As one cam (for example the cam 78) is rotated to cause the corresponding rod 76 to be extended downwardly, the corresponding chain 64 becomes effective for urging movement of the leg supports 20 toward one another.

More particularly, the control sprocket 71 of the other chain 63 may freely float vertically under the force only of the weight of the operating rod 75 on which the sprocket 71 is mounted. By such free vertical movement, the loop formed between the corresponding guide sprockets 67, 69 accommodates the variations in movement of the chain 63 without causing rotation of the corresponding cam 57 or the imposition of load thereupon from the weight stack 40. With the handle 80 rotated to an alternate position, weight from the stack 40 is imposed through the other chain 63 so as to cause the resistance force to bias the leg supports 20 outwardly and away from one another.

Figure 11:
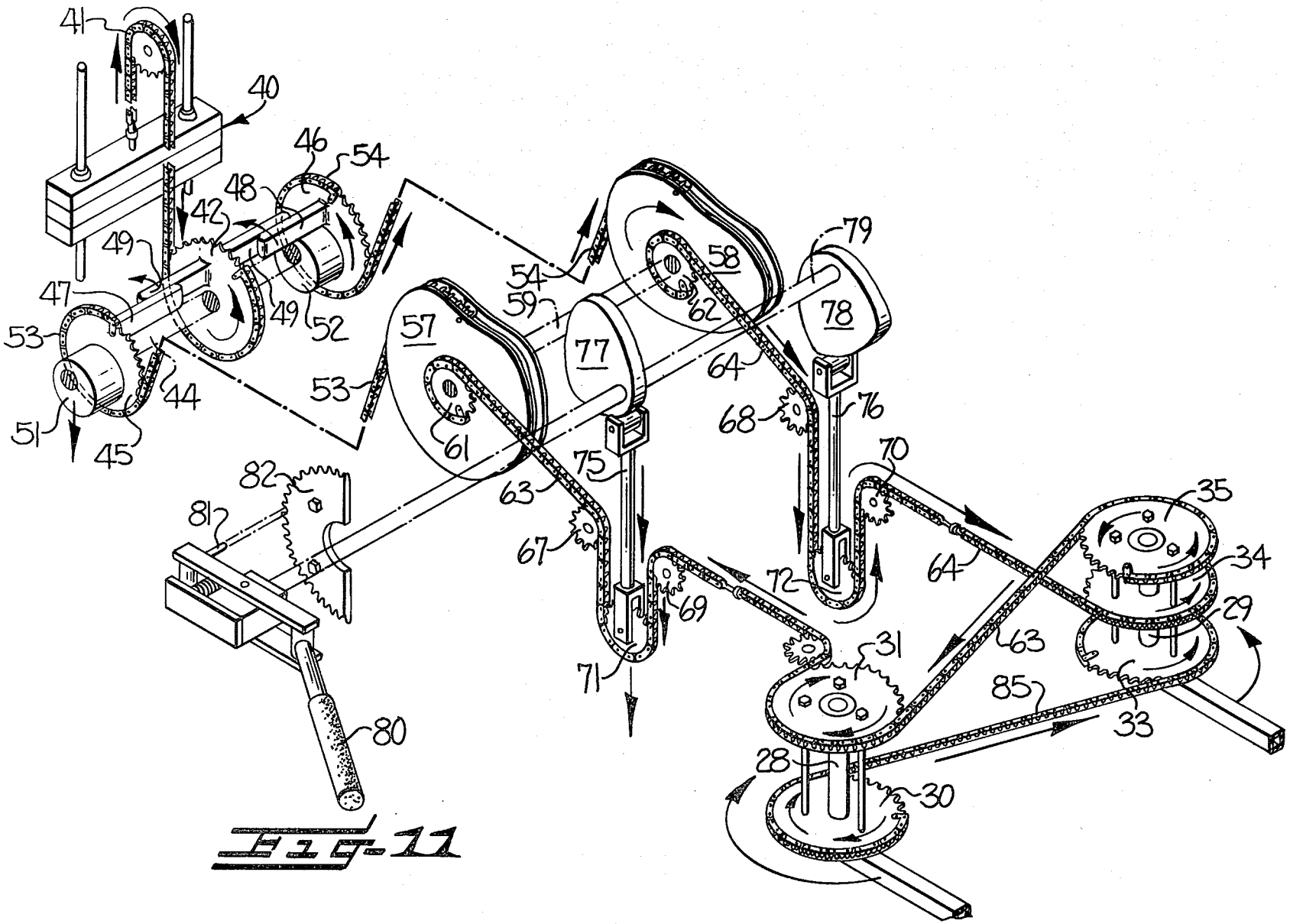
FIG. 11 is an exploded perspective view of portions of the apparatus of FIGS. 1 through 4 which imposes force resisting movement of the legs of a user.

As will become apparent from FIG. 11, the mounting means for the leg supports 20 comprises linking mechanism operatively connecting the right and left leg supports for restricting movement thereof to equiangular bilateral rotation away from and toward one another and thereby facilitating balanced exercise of right and left legs. In the preferred form of apparatus in accordance with the invention, illustrated in the drawings to which reference is now had, such a linking mechanism is present and takes the forms of one chain 63 described hereinabove which wraps about both a sprocket 31 attached to a right leg support and a sprocket 35 attached to a left leg support. A second linking chain 85 extends between two other sprockets 30, 33 and is crossed with the first mentioned chain 63 so as to assure, in the form particularly illustrated, that movement of the leg supports is bilaterally equiangular.

The selection mechanism here described serves yet another function during adductor exercise. That is, by controlling the position of the control sprocket 71 about which is entrained the chain 63 from the variation means or cam 57 which imposes force tending to spread the legs of a user, the relative position of the leg supports 20 can be controlled. By controlling the relative position of the leg supports 20, the extent to which the user is required to spread the user's legs is controlled. Stated differently, rotation of the cam shaft 79 and the cam 77 to varying positions permits a user to limit the extent to which the user is required to "do a split" by spreading the legs during use of the apparatus.

As will be appreciated, the dual functions and the selection means described hereinabove may be separated so as to permit the construction and use of an apparatus for conditioning only one of the abductor muscle set and the adductor muscle set. With such separation of function, it is preferred to retain a structure comparable to the selection means so as to permit control over the spreading of the legs and facilitate entry of the user into the apparatus in accordance with the present invention.

Figure 1:
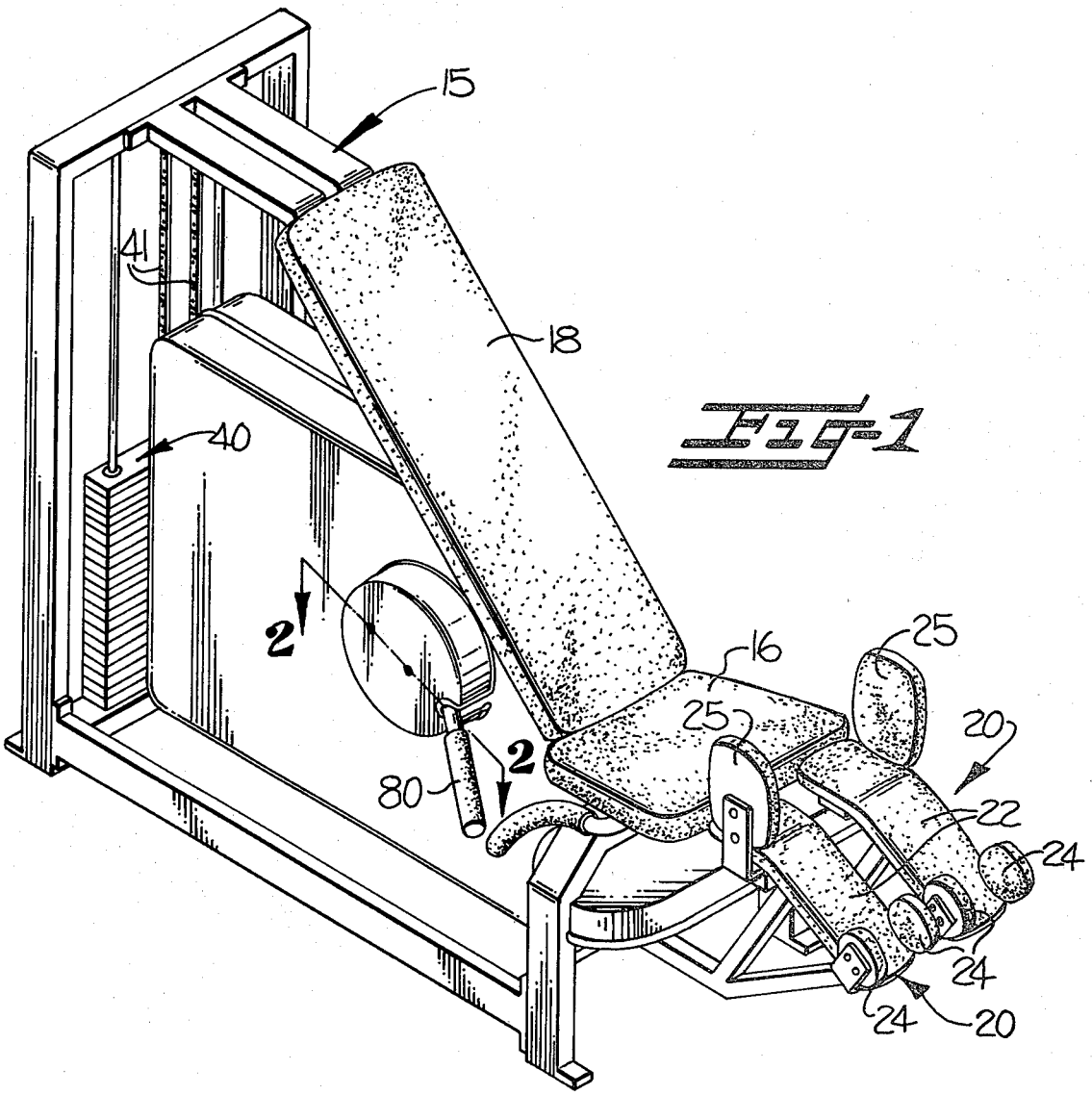
FIG. 1 is a perspective view of an apparatus in accordance with the present invention.
Figure 2:
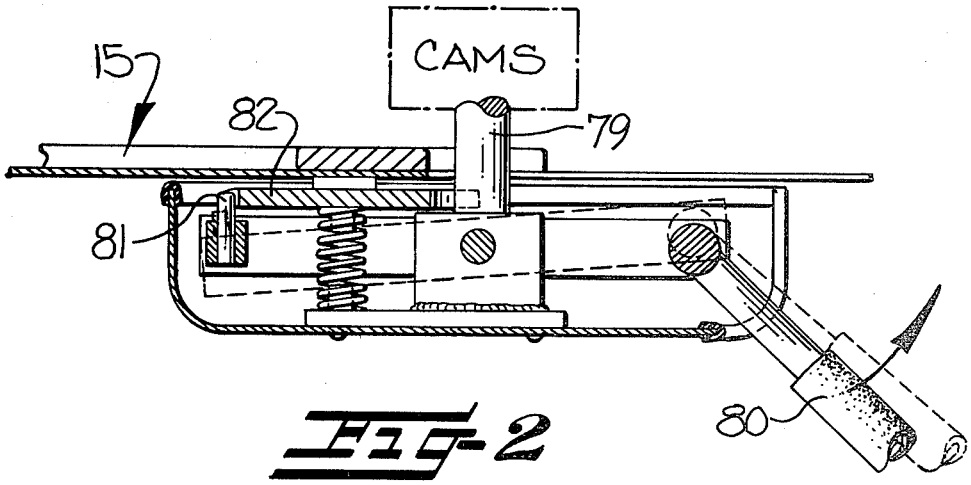
FIG. 2 is a plan view, partially in section, through a portion of the apparatus of FIG. 1, taken generally along the line 2—2 in FIG. 1.

In use, the apparatus will have been left with the selection means handle 80 positioned so that the leg supports 20 are moved together (as illustrated in FIG. 1). A user then enters the apparatus, is seated upon the seat, and leans backwardly against the backrest 18 to assume a reclining position. The thigh retainers 25 are moved to the appropriate side for the exercise to be first performed and the legs are positioned on the leg supports 20. Thereafter, if necessary or appropriate, the user manipulates the handle 80 to select which of the first and second variation means, in the forms of the cams 57, 58 and associated chains and sprockets, serves to impose force from the weight stack on the leg supports 20 and proceeds to engage in the exercise. Where desired, a user may terminate one series of movements, switch the thigh retainers 25 to the other side, move the selection means handle 80 to select the alternate exercise, and proceed using the other of the first and second variation means.

The use of the variation means in the apparatus of the present invention is significant as matching the force imposed to the force which can be demonstrated by the body parts involved. Movement of the weight stack 40 results in the tensioning of the associated chain 41 to a known, predetermined and essentially uniform extent. The essentially uniform force exerted through the chain 41 must be adapted to the varying force capable of being applied by the abductor and adductor muscles during exercising. That is, as the user's legs are moved away from and toward one another, the force of which the muscle sets are capable varies as a function of leg position. The first and second variation means accommodate the body part demonstrable force curves achievable by the user of the machine and thus facilitate full range exercise as mentioned hereinabove.

In the drawings and specification, there has been set forth a preferred embodiment of the invention, and although specific terms are employed, they are used in a generic and descriptive sense only and not for purposes of limitation.

That which is claimed is:

1. A method of exercising abductor or adductor muscles of the leg and comprising the steps of supporting the body of an exercising person for rotation of the right and left legs for movement away from and toward one another and about an axis extending through the corresponding hip joints, while restricting movement of the legs to equiangular bilateral rotation away from and toward one another and thereby facilitating balanced exercise of right and left legs, while imposing on the legs a force resisting movement of the legs in at least one of the directions of away from and toward the other leg, and while varying the amount of resisting force imposed in predetermined relationship to movement of the legs away from and toward one another during each exercising movement of the legs.

2. Appatatus for exercising abductor or adductor muscles of the leg and comprising:

torso supporting means for supporting a user's upper body, right and left leg support means for supporting a user's corresponding right and left legs, means mounting said right and left leg support means for rotation relative to said torso supporting means and about an axis extending through the corresponding hip joints of the user, resistance means operatively connected to said mounting means for imposing on said right and left leg support means a variable force resisting movement of said right and left leg support means in at least one of directions of away from and toward the user's other leg, said resistance means including variable radius cam means for progressively changing the amount of force imposed in predetermined relationship to the various positions of movement of said right and left leg support means away from and toward the user's other leg, linking means operatively connecting said right and left leg supports for restricting movement thereof to equiangular bilateral rotation away from and toward one another and thereby facilitating balanced exercise of the right and left legs of the user and selection means interposed in said operative connection between said resistance means and said mounting means and being operable by the user for selectively applying said resistance force during either outward or inward equiangular bilateral movement of said right and left leg support means.

3. Apparatus according to claim 2 wherein said linking means comprises first and second sprockets fixed on said mounting means of said right leg support means, first and second sprockets fixed on said mounting means of said left leg support means, a first chain extending between and at least partially surrounding said first sprockets of said right and left leg support means in opposite directions so that outward movement of one leg support imparts equal outward movement to the other leg support, and a second chain extending between and at least partially surrounding said second sprockets of said right and left leg support means so that inward movement of one leg support imparts equal inward movement to the other leg support.

4. Apparatus according to claim 2 wherein said resistance means comprises a weight stack, and said variable radius cam means includes first and second variable radius cams, said operative connection includes third and fourth chains operatively connected to said weight stack and connected to respective first and second variable radius cams, third and fourth sprockets fixed to respective first and second variable radius cams, and fifth and sixth chains connected at one end to respective third and fourth sprockets and being operatively connected at their other ends to said first and second sprockets of said right and left leg supports.

5. Apparatus according to claim 4 wherein said selection means includes a first pair of idler sprockets engaged by said fifth chain, a first idler sprocket engaging said fifth chain between said first pair of idler sprockets and forming a V-shaped configuration in said fifth chain, a first actuating rod rotatably supporting said first idler sprocket on one end thereof, a first control cam operatively engageable with the other end of said first actuation rod, a second pair of idler sprockets engaged by said sixth chain, a second idler sprocket engaging said sixth chain between said first pair of idler sprockets and forming a V-shaped configuration in said sixth chain, a second actuating rod rotatably supporting said second idler sprocket on one end thereof, a second control cam operatively engageable with the other end of said second actuating rod, a shaft fixed to said first and second cams, and a handle connected to said shaft and being movable between first and second positions by the user for imparting rotational movement thereto, said second control cam being operable to increase the V-shaped configuration of said sixth chain and said first control cam being operable to decrease the V-shaped configuration of said fifth chain with movement of said handle to said first position so that said right and left leg support means is moved inwardly and the legs of the user are moved away from each other to lift said weight stack, said first control cam being operable to increase the V-shaped configuration of said fifth chain and said second control cam being operable to decrease the V-shaped configuration of said sixth chain with movement of said handle to said second position so that said right and left leg support means is moved outwardly and the legs of the user are moved toward each other to lift said weight stack.

* * * * *